US010214847B2

(12) United States Patent
Nakamoto

(10) Patent No.: US 10,214,847 B2
(45) Date of Patent: Feb. 26, 2019

(54) DRUM WASHING MACHINE

(71) Applicants: HAIER ASIA CO., LTD., Tokyo (JP); QINGDAO HAIER WASHING MACHINE CO., LTD., Shandong (CN)

(72) Inventor: Shigeharu Nakamoto, Shando (CN)

(73) Assignees: Haier Asia Co., Ltd. (JP); Qingdao Haier Washing Machine Co., Ltd. (CN)

( * ) Notice: Subject to any disclaimer, the term of this patent is extended or adjusted under 35 U.S.C. 154(b) by 128 days.

(21) Appl. No.: 15/506,549

(22) PCT Filed: Aug. 28, 2015

(86) PCT No.: PCT/CN2015/088438
§ 371 (c)(1),
(2) Date: Jul. 24, 2017

(87) PCT Pub. No.: WO2016/029881
PCT Pub. Date: Mar. 3, 2016

(65) Prior Publication Data

US 2017/0350057 A1 Dec. 7, 2017

(30) Foreign Application Priority Data

Aug. 29, 2014 (JP) ..... 2014-176181

(51) Int. Cl.
*D06F 37/36* (2006.01)
*D06F 33/02* (2006.01)
(Continued)

(52) U.S. Cl.
CPC ..... *D06F 37/36* (2013.01); *D06F 23/02* (2013.01); *D06F 33/02* (2013.01); *D06F 37/04* (2013.01);
(Continued)

(58) Field of Classification Search
CPC ..... D06F 37/04; D06F 37/36; D06F 37/40; D06F 23/02; D06F 39/003; D06F 2202/10; D06F 2202/12
(Continued)

(56) References Cited

U.S. PATENT DOCUMENTS

2012/0118022 A1* 5/2012 Ashrafzadeh ..... D06F 33/02 68/12.04
2013/0118212 A1* 5/2013 Jun ..... H02K 21/12 68/140
2014/0190219 A1 7/2014 Kim et al.

FOREIGN PATENT DOCUMENTS

CN 2576758 Y 10/2003
CN 1453416 A 11/2003
(Continued)

OTHER PUBLICATIONS

European Search Report from related EP Application No. 15834998.5 dated Mar. 19, 2018.

*Primary Examiner* — Michael E Barr
*Assistant Examiner* — Tinsae B Ayalew
(74) *Attorney, Agent, or Firm* — Burns & Levinson, LLP; Joseph M. Maraia

(57) ABSTRACT

Provided is a drum washing machine, including: an outer tank, configured in a shell; a drum, configured in the outer tank and capable of rotating by using a horizontal shaft or an inclination shaft inclining relative to a horizontal direction as a center; a rotating body, configured at a rear part of the drum and having protruding parts in contact with washings on a surface of the rotating body; a driving part, capable of operating in a first drying form and a second driving form, wherein the first driving form refers to a driving form which enables the drum and the rotating body to rotate at different rotating speeds, and the second driving form refers to a driving form which enables the drum and the rotating body
(Continued)

to rotate integrally at the same rotating speed; and a control part.

7 Claims, 11 Drawing Sheets

(51) Int. Cl.

| | |
|---|---|
| ***D06F 37/04*** | (2006.01) |
| ***D06F 37/40*** | (2006.01) |
| ***D06F 23/02*** | (2006.01) |
| ***D06F 39/00*** | (2006.01) |
| *D06F 23/06* | (2006.01) |

(52) U.S. Cl.
CPC ..... *D06F 37/40* (2013.01); *D06F 39/003* (2013.01); *D06F 23/06* (2013.01); *D06F 2202/10* (2013.01); *D06F 2202/12* (2013.01)

(58) Field of Classification Search
USPC ..... 68/12.04
See application file for complete search history.

(56) References Cited

FOREIGN PATENT DOCUMENTS

| | | | |
|---|---|---|---|
| CN | 1888202 | A | 1/2007 |
| EP | 1439255 | A1 | 7/2004 |
| EP | 2719813 | A2 | 4/2014 |
| JP | 03280992 | A | 12/1991 |
| JP | 05-168786 | | 7/1993 |
| KR | 950007852 | B1 | 7/1995 |
| KR | 19990085002 | | 12/1999 |
| KR | 20050087342 | A | 8/2005 |

* cited by examiner

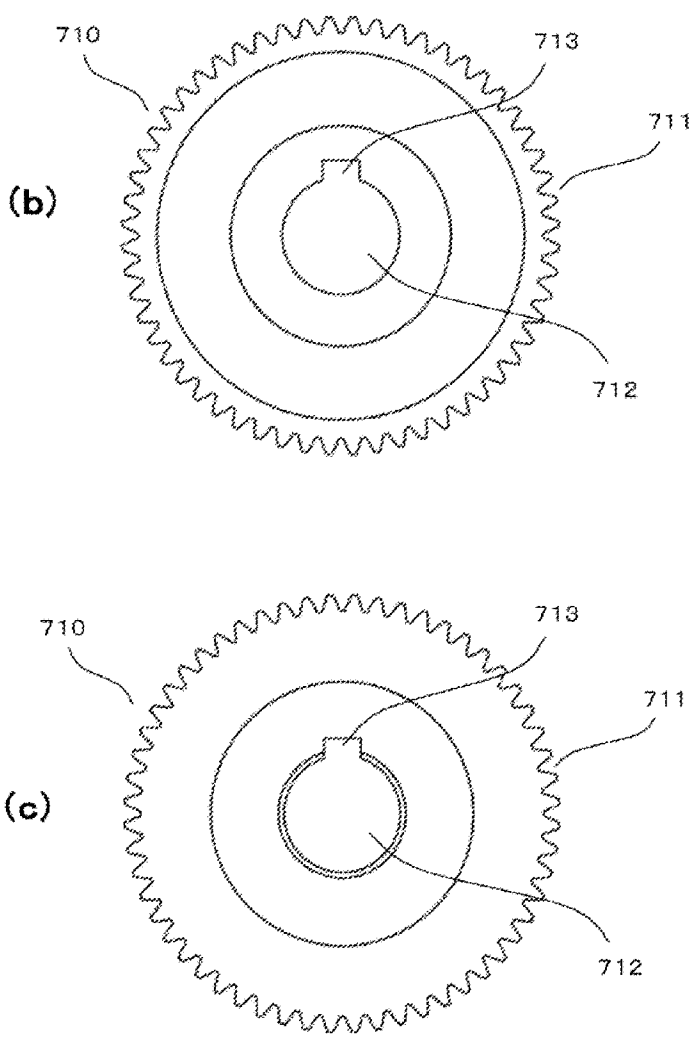
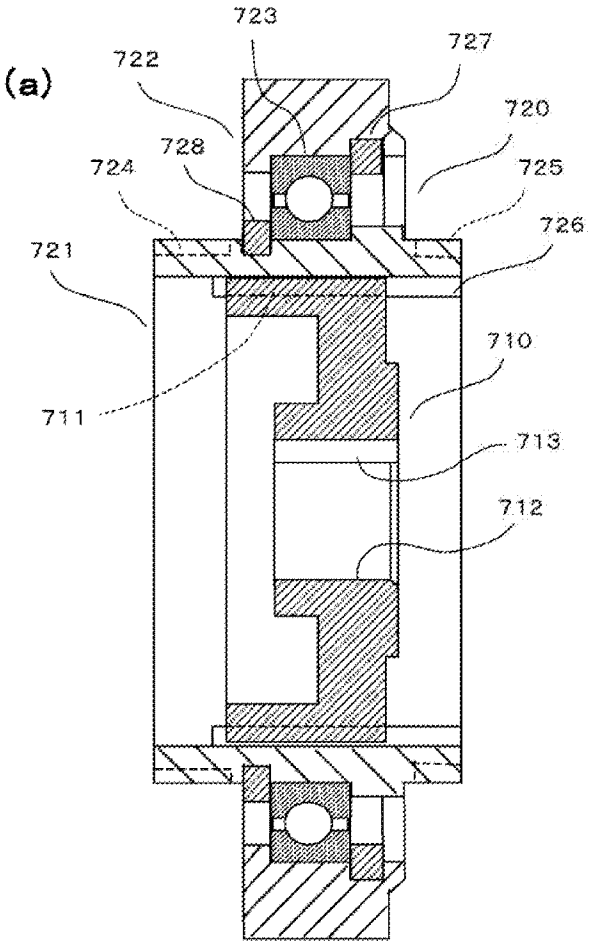
FIG.5

(a)

802a

| Load quantity | Difference |
|---|---|
| M1 | Less than C1 |
| M2 | Greater than or equal to C1 and less than C2 |
| M3 | Greater than or equal to C2 and less than C3 |
| ⋮ | ⋮ |
| Mn | Greater than or equal to Cn and less than Cn+1 |

Load quantity table

M1<M2<M3····<Mn

C1<C2<C3····<Cn<Cn+1

(b)

802b

| Load quantity | Water supply quantity |
|---|---|
| M1 | L1 |
| M2 | L2 |
| M3 | L3 |
| ⋮ | ⋮ |
| Mn | Ln |

Water supply quantity table

L1<L2<L3····<Ln (c)

802c

| Load quantity | Detergent quantity |
|---|---|
| M1 | G1 |
| M2 | G2 |
| M3 | G3 |
| ⋮ | ⋮ |
| Mn | Gn |

Detergent quantity table

G1<G2<G3····<Gn

FIG.8

DRUM WASHING MACHINE

TECHNICAL FIELD

The present disclosure relates to a drum washing machine, which not only can be continuously operated from washing to drying, but also can carry out washing without drying.

BACKGROUND

In the past, a drum washing machine rotates a transverse-shaft type drum in an outer tank which stores water at the bottom, washings are lifted up and dropped down by baffles arranged in the drum, and the washings are thrown to an inner circumferential surface of the drum to wash the washings.

In this way, in a structure of stirring the washings by the baffles, the washings are difficult to twine or rub against each other. Therefore, compared with an automatic washing machine which washes the washings through rotation of a pulsator in a washing and dewatering tank, the drum washing machine has mechanical force, acting on the washings, easy to get small, and has detergency easy to lower.

Therefore, for the drum washing machine, in order to improve the detergency, the following structure may be adopted: a rotating body with a protruding part is arranged at the rear part of the drum and the drum and the rotating body can rotate at different rotating speeds during washing and rinsing (with reference to patent literature 1).

CURRENT TECHNICAL LITERATURE

Patent Literature

Patent Literature 1: Japanese Laid-Open Patent Publication No. 03-280992

SUMMARY

Problems to be Solved in the Disclosure

However, in the drum washing machine, prior to water supply in a washing process, the load quantity of the washings in the drum is usually detected, and water supply quantity and detergent quantity are set according to the load quantity. The load quantity is detected according to a rotating load applied to the drum when the drum rotates at a rotating speed at which the washings are attached to an inner circumferential surface of the drum.

Since a friction coefficient when the washings are in a dry state is higher than that in a wetted state, cloth damage is easily caused. Since the load quantity is detected before water is supplied into a water tank, the washings are usually dry when the load quantity is detected. Therefore, cloth damage of the washings is possibly generated when the drum rotates.

Especially, in the drum washing machine in which the rotating rotate is arranged at the rear part of the drum, cloth damage of the washings is also possibly generated due to rotation of the rotating body when the load quantity is detected.

The present disclosure is accomplished in view of the problems, and aims to provide a drum washing machine capable of avoiding generating cloth damage of the washings when the load quantity is detected.

Solution for Solving the Problems

A drum washing machine in a main embodiment of the present disclosure includes: an outer tank, configured in a shell; a drum, configured in the outer tank and capable of rotating by using a horizontal axis or an inclination axis inclining relative to a horizontal direction as a center; a rotating body, arranged at a rear part of the drum and provided with a protruding part in contact with washings on a surface of the rotating body; a driving part, capable of operating in a first driving form and a second driving form, wherein the first driving form is a driving form that enables the drum and the rotating body to rotate at different rotating speeds and the second driving form is a driving form that enables the drum and the rotating body to integrally rotate at a same rotating speed; and a control part, wherein the control part detects the load quantity of the washings in the drum and enables the driving part to operate in the second driving form while detecting the load quantity.

According to the above structure, when the load quantity is detected, since the drum and the rotating body integrally rotate and the rotating body does not rotate relative to the drum, a condition that the washings are rubbed by the rotating body that rotates does not occur. Therefore, the load quantity is detected without worrying about cloth damage of the washings due to the rotation of the rotating body.

In the drum washing machine in the present embodiment, the control part can be configured to enable the driving part to operate in the second driving form so that the drum rotates at the first rotating speed at which the washings are at least attached to the inner circumferential surface of the drum, and to detect the load quantity based on rotating load applied to the drum when the drum rotates at the first rotating speed.

More specifically, the driving part can adopt a structure that includes the drum and a driving motor that generates a torque to rotate the rotating body. In addition, the drum washing machine can further include a motor driving part for providing driving current to the driving motor, and a current detecting part for detecting the driving current. Moreover, the control part enables the driving motor to operate in the second driving form so that the drum rotates at the first rotating speed, and detects the load quantity based on magnitude of the driving current detected by the current detecting part when the drum rotates at the first rotating speed.

To detect the load quantity, under the condition of adopting the structure that the drum rotates at the rotating speed at which the washings can be attached to the inner circumferential surface of the drum, when a structure is adopted that enables the driving part to operate in the first driving form when the load quantity is detected, since the rotating body rotates at the rotating speed higher than that in a washing process and that in a rinsing process, cloth damage of the washings is generated more possibly. Therefore, in such structure, if the structure is adopted that the driving part is operated in the second driving form when the load quantity is detected, since cloth damage of the washings does not need to be worried about, such structure is also applicable.

As mentioned above, to detect the load quantity, under the condition of adopting the structure that the drum rotates at the rotating speed at which the washings can be attached to the inner circumferential surface of the drum, the following structure can be further adopted: before the driving part is operated in the second driving form for detecting the load quantity, the control part enables the driving part to operate in the first driving form so that the drum rotates at a second rotating speed at which the washings can be rolled in the drum.

If such structure is adopted, before the load quantity is detected, the washings can be loosened by rolling the washings in the drum. Thus, since the washings can be loosened and attached to the inner circumferential surface of the drum when the load quantity is detected, eccentric rotation of the drum caused by centralized attachment of the washings can be inhibited so as to detect the load quantity with good precision. Moreover, since the washings not only are rolled due to the rotation of the drum, but also are stirred by the rotating body, a coil of washings becomes easier to be loosened.

Under the condition of adopting the above structure, a structure with a braking part for braking the rotating drum can be adopted. In this case, the control part brakes the drum through the braking part when stopping the drum rotating at the second rotating speed.

If such structure is adopted, the drum is braked, so the drum is rapidly stopped. Thus, at this moment, strong inertial force is applied to the washings in the drum, so that a coil of washings becomes easy to be loosened.

Effects of the Disclosure

According to the present disclosure, a drum washing machine can be provided, capable of avoiding generating cloth damage of the washings when the load quantity is detected.

Effects and significances of the present disclosure are further clarified by embodiments shown below. However, the following embodiments are just an illustration when the present disclosure is implemented, and the present disclosure is not limited by any content described in the following embodiments.

BRIEF DESCRIPTION OF DRAWINGS

FIGS. 5(*a*) to 5(*c*) are diagrams illustrating structures of a clutch guider and a clutch body involved in embodiments.

FIGS. 8(*a*) to 8(*c*) are diagrams illustrating a load quantity table, a water supply quantity table and a detergent quantity table involved in embodiments.

DETAILED DESCRIPTION

Hereinafter, a drum washing machine without a drying function as an embodiment of the drum washing machine in the present disclosure is described by referring to drawings.

Figure 1:
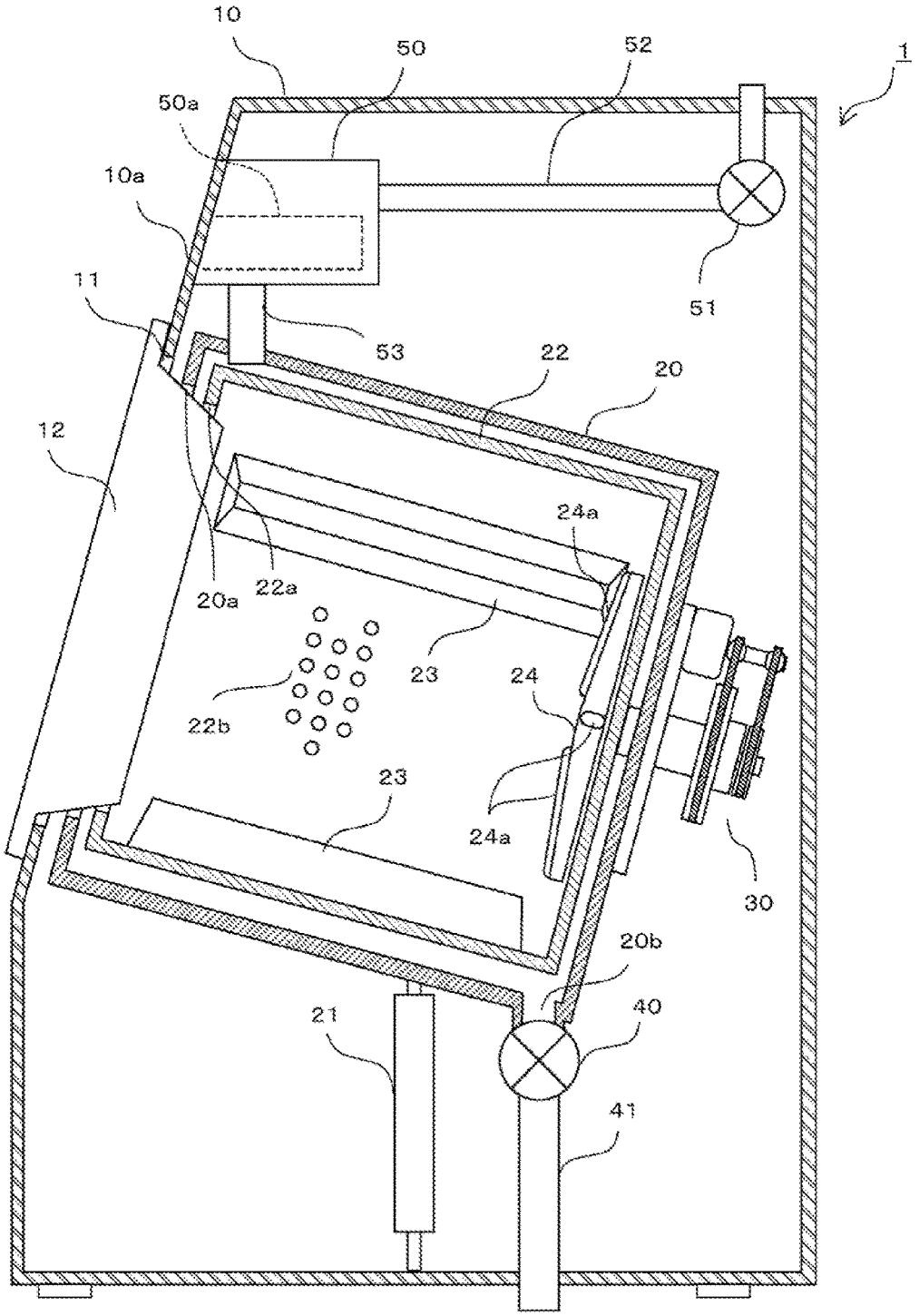
FIG. 1 is a side sectional view illustrating a structure of a drum washing machine involved in embodiments.

FIG. 1 is a side sectional view illustrating a structure of a drum washing machine 1.

The drum washing machine 1 includes a shell 10 forming an appearance. A front surface 10*a* of the shell 10 is inclined from a central part to an upper part, and a throwing inlet 11 of the washings is formed in an inclined surface. The throwing inlet 11 is covered by a door 12 which is freely openable and closable.

An outer tank 20 is elastically supported by a plurality of vibration dampers 21 in the shell 10. A drum 22 is configured in the outer tank 20 in a freely rotatable manner. The outer tank 20 and the drum 22 are inclined in such a manner that a rear surface side is lowered relative to a horizontal direction. Thus, the drum 22 rotates by taking an inclination axis inclining relative to the horizontal direction as a center. The inclination angle of the outer tank 20 and the drum 22 may be set as about 10-20 degrees. An opening part 20*a* on the front surface of the outer tank 20 and an opening part 22*a* on the front surface of the drum 22 are opposite to the throwing inlet 11, and are opened and closed together with the throwing inlet 11 by the door 12. A plurality of dewatering holes 22*b* are formed in a circumferential wall of the drum 22. Further, three baffles 23 are arranged in the circumferential direction at roughly equal intervals on the inner circumferential surface of the drum 22.

A rotating body 24 is configured at the rear of the drum 22 in a freely rotatable manner. The rotating body 24 has a roughly disc shape. A plurality of protruding parts 24*a* that radially extend from the central part are formed in the surface of the rotating body 24. The rotating body 24 coaxially rotates with the drum 22.

A driving part 30 generating a torque for driving the drum 22 and the rotating body 24 is configured at the rear of the outer tank 20. The driving part 30 enables the drum 22 and the rotating body 24 to rotate at different rotating speeds in the same direction in a washing process and a rinsing process.

Specifically, the driving part 30 enables the drum 22 to rotate at a rotating speed that centrifugal force applied to the washings in the drum 22 is smaller than gravity of the washings, and the rotating body 24 rotates at a rotating speed higher than the rotating speed of the drum 22. On the other hand, the driving part 30 enables the drum 22 and the rotating body 24 to integrally rotate at a rotating speed that the centrifugal force applied to the washings in the drum 22 becomes much larger than the gravity of the washings in a dewatering process. A detailed structure of the driving part 30 is described below.

A water outlet part 20*b* is formed at the bottom of the outer tank 20. A drainage valve 40 is configured in the water outlet part 20*b*. The drainage valve 40 is connected with a drainage hose 41. When the drainage valve 40 is opened, water stored in the outer tank 20 would be discharged out of the machine by the drainage hose 41.

A detergent box 50 is configured on the front upper part of the shell 10. A detergent container 50*a* containing detergents is contained in the detergent box 50 from the front in a free withdrawal manner. The detergent box 50 is connected with a water supply valve 51 configured on the rear upper part of the shell 10 through a water supply hose 52. In addition, the detergent box 50 is connected with the upper part of the outer tank 20 through a water injection pipe 53.

When the water supply valve 51 is opened, tap water from a faucet is supplied into the outer tank 20 by virtue of a water supply hose 52, the detergent box 50 and the water injection pipe 53. At this moment, the detergents contained in the detergent container 50*a* are supplied into the outer tank 20 along with a water flow.

Then, a structure of the driving part 30 is described in detail.

Figure 2:
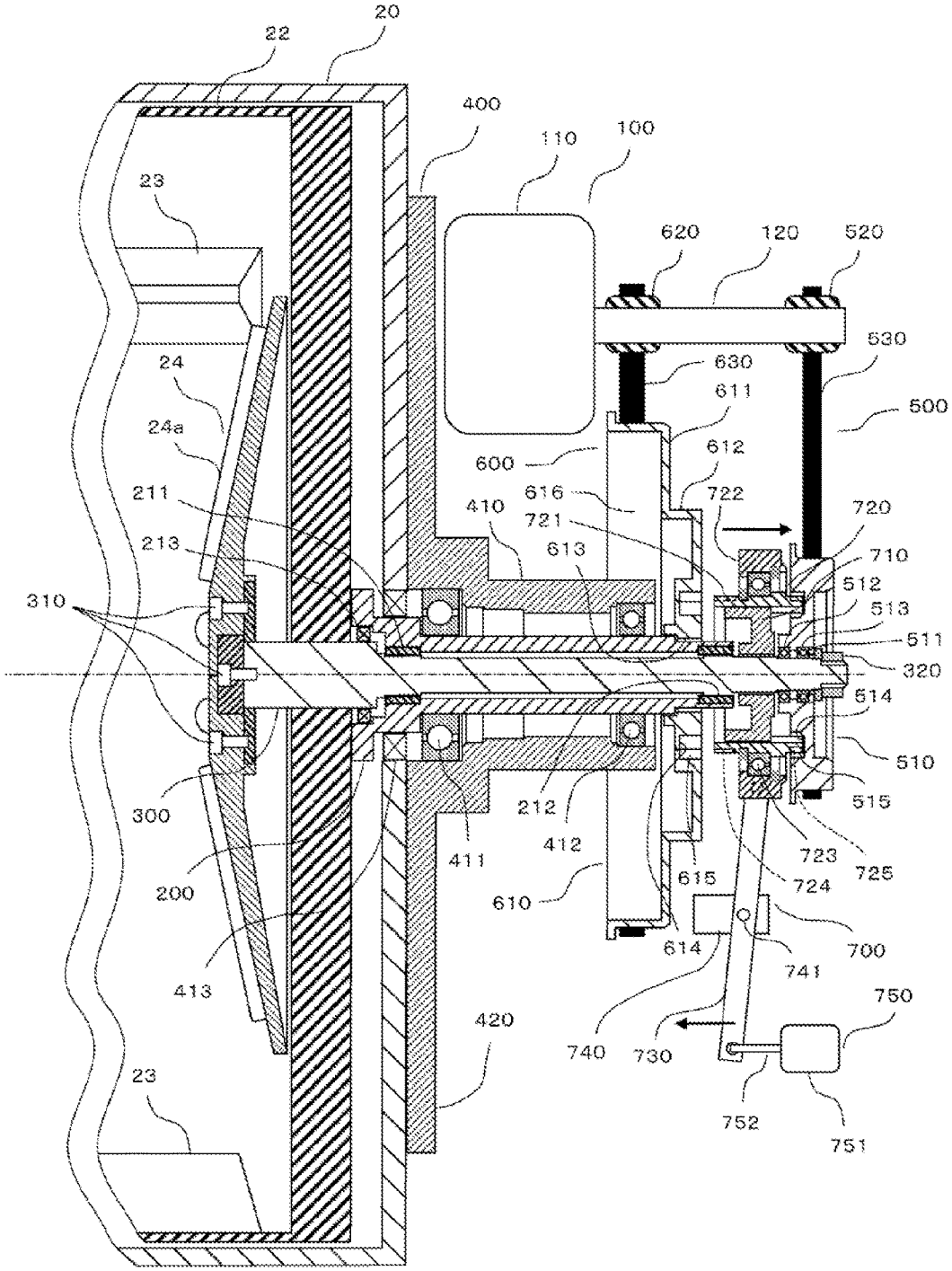
FIG. 2 is a sectional view illustrating a structure of a driving part involved in embodiments.
Figure 3:
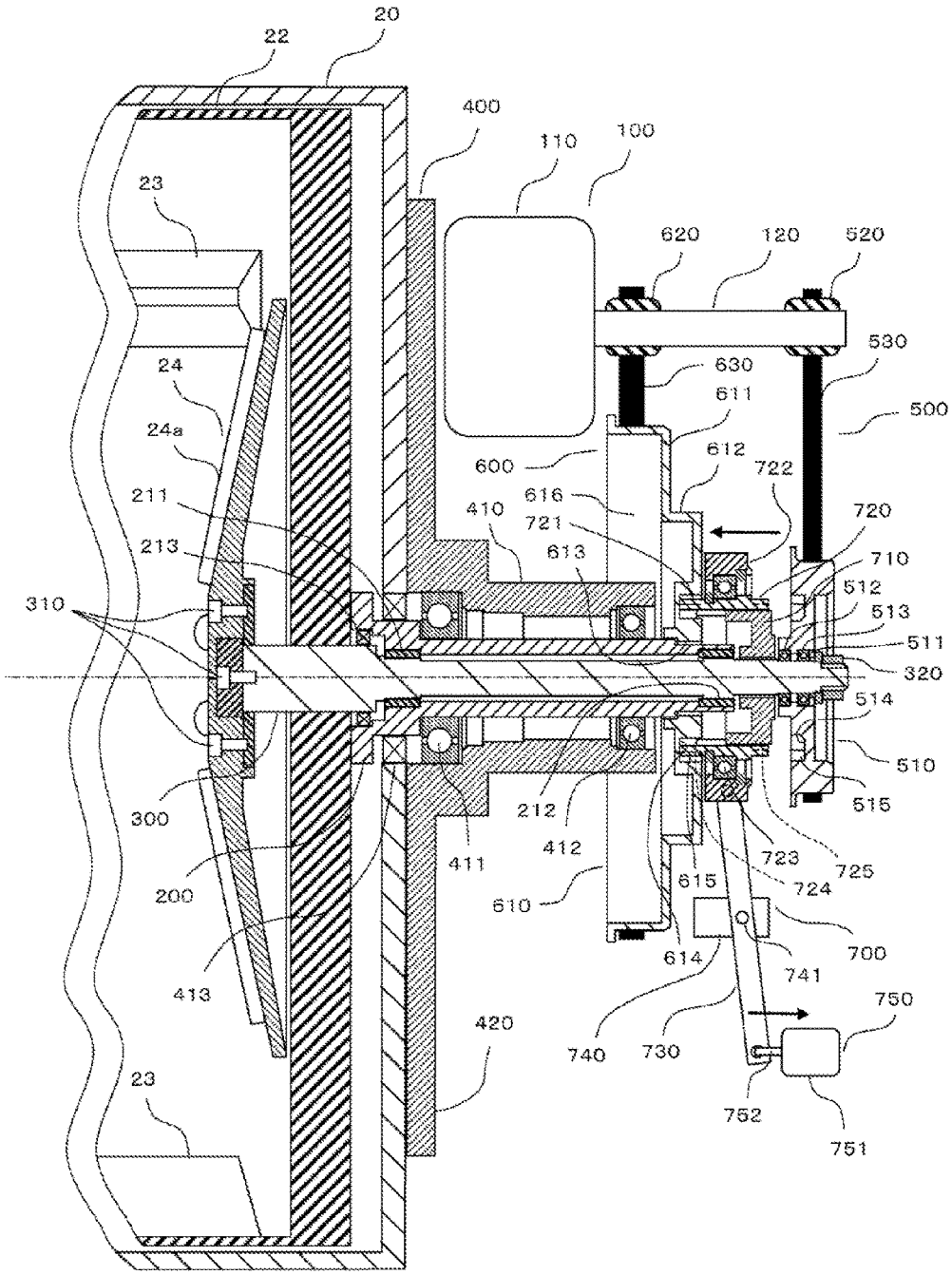
FIG. 3 is a sectional view illustrating a structure of a driving part involved in embodiments.
Figure 4:
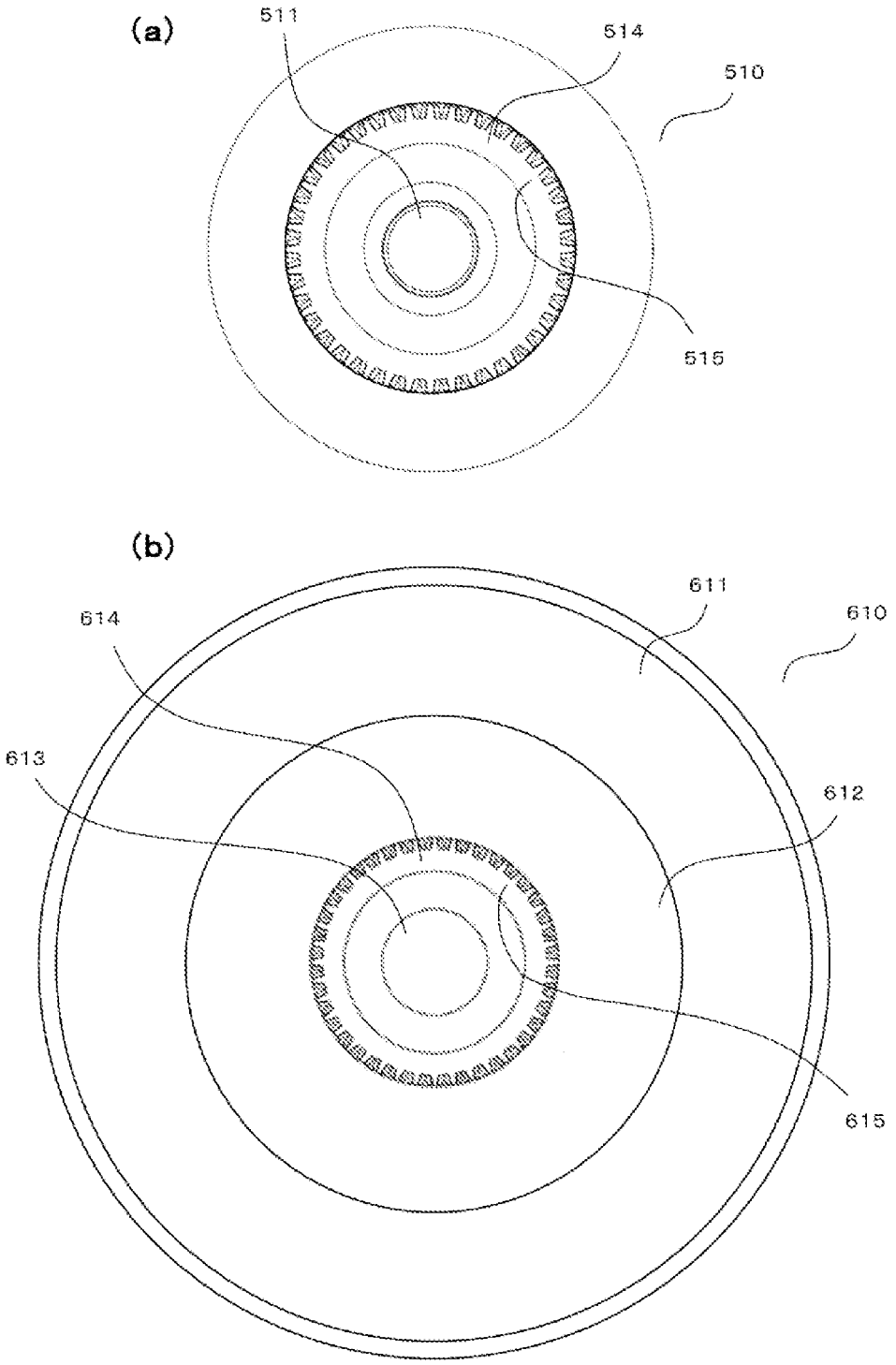
FIGS. 4(*a*) and 4(*b*) are diagrams illustrating structures of a wing belt wheel and a drum belt wheel involved in embodiments.
Figure 6:
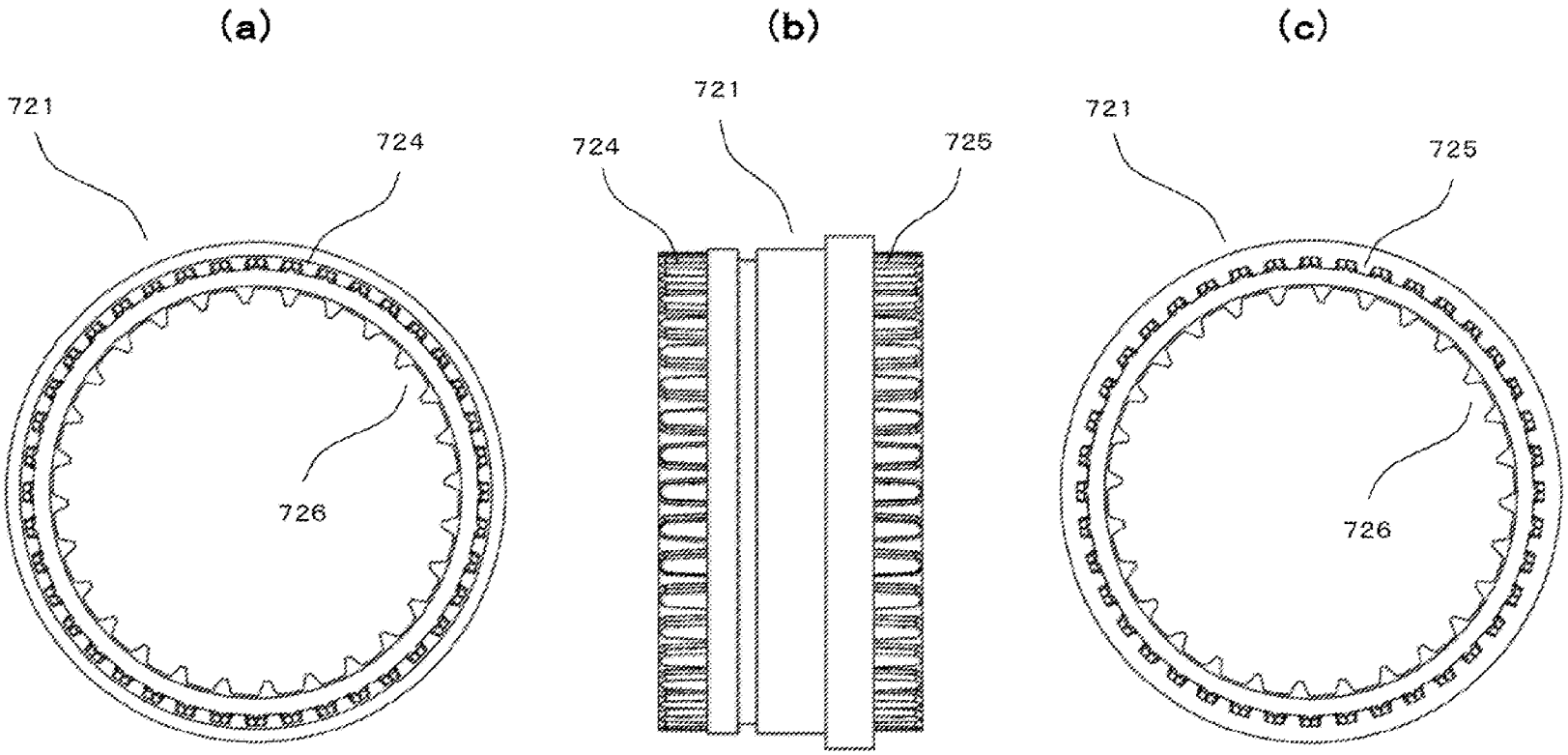
FIGS. 6(*a*) to 6(*c*) are diagrams illustrating structures of a clutch part forming a clutch body involved in embodiments.

FIG. 2 and FIG. 3 are sectional views illustrating a structure of the driving part 30. FIG. 2 shows a state of switching a driving form of the driving part 30 to a biaxial driving form. FIG. 3 shows a state of switching a driving form of the driving part 30 to a uniaxial driving form. FIG. 4 is a diagram illustrating a wing belt wheel 510 and a drum belt wheel 610. FIG. 4(*a*) is a diagram illustrating the wing belt wheel 510 viewed from the front, and FIG. 4(*b*) is a diagram illustrating the drum belt wheel 610 viewed from the rear. FIG. 5 is a diagram illustrating a structure of a clutch guider 710 and a clutch body 720. FIG. 5(*a*) is a side sectional view illustrating a clutch guider 710 and a clutch body 720, FIG. 5(*b*) is a diagram illustrating the clutch guider 710 viewed from the front, and FIG. 5(*c*) is a diagram illustrating the clutch guider 710 viewed from the rear. FIG. 6 is a diagram illustrating a structure of a clutch part 721 forming the clutch body 720. FIG. 6(*a*) is a diagram illustrating the clutch part 721 viewed from the front, FIG. 6(*b*) is a side view illustrating the clutch part 721 and FIG. 6(*c*) is a diagram illustrating the clutch part 721 viewed from the rear.

The driving part 30 includes: a driving motor 100, a first rotating shaft 200, a second rotating shaft 300, a bearing unit 400, a wing decelerating mechanism 500, a drum decelerating mechanism 600 and a clutch mechanism part 700.

The driving motor 100 generates torques for driving the drum 22 and the rotating body 24; the driving motor 100 is, for example, an outer rotor type DC brushless motor; and a motor shaft 120 connected with a rotor in the shell 110 extends backwards from the shell 110.

The first rotating shaft 200 is of a hollow shape; a first sliding bearing 211 and a second sliding bearing 212 are respectively arranged at an inner part, a front part and a rear part of the first rotating shaft 200; and a mechanical sealing element 213 is arranged at a front end part.

The second rotating shaft 300 is encircled in the first rotating shaft 200; the front part of the second rotating shaft 300 protrudes forward from the first rotating shaft 200; the rear part of the second rotating shaft 300 protrudes backwards from the first rotating shaft 200; the outer circumferential surface of the second rotating shaft 300 is supported by the first sliding bearing 211 and the second sliding bearing 212; the second rotating shaft 300 smoothly rotates within the first rotating shaft 200. In addition, the water can be prevented from entering between the second rotating shaft 300 and the first rotating shaft 200 through the mechanical sealing element 213.

A bearing part 410 with a roughly cylindrical shape is arranged in the central part of the bearing unit 400; a first rolling bearing 411 and a second rolling bearing 412 are respectively arranged on the front part and the rear part inside the bearing part 410; a mechanical sealing element 413 is arranged at the front end part; the outer circumferential surface of the first rotating shaft 200 is supported by the first rolling bearing 411 and the second rolling bearing 412; the first rotating shaft 200 smoothly rotates within the bearing part 410. In addition, the water can be prevented from entering between the first rotating shaft 200 and the bearing part 410 through the mechanical sealing element 413. Furthermore, a fixing flange part 420 is formed around the bearing part 410 of the bearing unit 400.

The bearing unit 400 is fixed on the rear surface of the outer tank 20 by a fixing method such as screw fastening and the like through the fixing flange part 420; the second rotating shaft 300 and the first rotating shaft 200 enter the interior of the outer tank 20 when the bearing unit 400 is mounted in the outer tank 20; the drum 22 is fixed to the first rotating shaft 200 by a screw not shown in figures; and the rotating body 24 is fixed to the second rotating shaft 300 by a screw 310.

The wing decelerating mechanism 500 includes a wing belt wheel 510, a first motor belt wheel 520 and a wing transmission belt 530; the rotation of the driving motor 100 is decelerated according to a deceleration ratio determined by an outer diameter ratio of the wing belt wheel 510 and the first motor belt wheel 520 and is transmitted to the second rotating shaft 300.

The wing belt wheel 510 is supported by the rear end part of the second rotating shaft 300 in a freely rotatable manner; an insertion hole 511 into which the second rotating shaft 300 is inserted is formed in the central part of the wing belt wheel 510; a front and a rear rolling bearings 512 and 513 are clamped between the insertion hole 511 and the second rotating shaft 300; and the wing belt wheel 510 smoothly rotates relative to the second rotating shaft 300 through the two rolling bearings 512 and 513.

As shown in FIG. 4(*a*), an annular engaged recess part 514 is formed on a front surface of the wing belt wheel 510; a rack 515 is formed on the outer circumferential surface of the engaged recess part 514 throughout the entire circumference; and the wing belt wheel 510 is prevented from falling backward through a fixing screw 320 mounted at the rear end part of the second rotating shaft 300.

The first motor belt wheel 520 is mounted at the front end part of the motor shaft 120 of the driving motor 100; and the wing transmission belt 530 is erected between the wing belt wheel 510 and the first motor belt wheel 520.

The drum decelerating mechanism 600 includes a drum belt wheel 610, a second motor belt wheel 620 and a drum transmission belt 630; the rotation of the driving motor 100 is decelerated according to the deceleration ratio determined by the outer diameter ratio of the drum belt wheel 610 and the second motor belt wheel 620 and is transmitted to the first rotating shaft 200.

The drum belt wheel 610 is formed as a disc shape with an opened front surface, and includes a belt wheel part 611 and a fixing part 612 which has an outer diameter smaller than that of the belt wheel part 611. The deceleration ratio generated by the drum reduction mechanism 600 is greater than the deceleration ratio generated by the wing decelerating mechanism 500 due to the outer diameter of the belt wheel part 611, i.e., the outer diameter of the drum belt wheel 610 is greater than the outer diameter of the wing belt wheel 510.

An insertion hole 613 is formed in the central part of the fixing part 612; the rear end part of the first rotating shaft 200 is inserted into the insertion hole 613 and is fixed in the insertion hole 613 by a defined fixing method such as pressing with the rack and the like; as a result, the drum belt wheel 610 is fixed at the rear end part of the first rotating shaft 200.

As shown in FIG. 4(*b*), an annular engaged recess part 614 is formed on the rear surface of the fixing part 612 in the outer circumference of the insertion hole 613; and a rack 615 is formed on the outer circumferential surface of the engaged recess part 614 throughout the entire circumference.

The rear end part of the bearing part 410 is accommodated in a recess part 616 recessed backwards, i.e., the interior of the belt wheel part 611; and as a result, the bearing unit 400 is overlapped with the drum belt wheel 610 in a front-and-back direction of the driving part 30.

The second motor belt wheel 620 is mounted at a root part of the motor shaft 120 of the driving motor 100; and a drum transmission belt 630 is erected between the drum belt wheel 610 and the second motor belt wheel 620.

The clutch mechanism part 700 switches the driving form of the driving part 30 between the biaxial driving form and the uniaxial driving form, wherein the biaxial driving form refers to a form that the second rotating shaft 300 can be connected with the wing belt wheel 510 in a manner of transmitting the rotation of the wing belt wheel 510 to the second rotating shaft 300 so as to rotate the drum 22 and the rotating body 24 at mutually different rotating speeds; the uniaxial driving form refers to a form that the second rotating shaft 300 can be connected with the drum belt wheel 610 in a manner of transmitting the rotation of the drum belt wheel 610 to the second rotating shaft 300 so as to rotate the drum 22 and the rotating body 24 at the same rotating speed. The biaxial driving form is equivalent to the first driving form of the present disclosure; and the uniaxial driving form is equivalent to the second driving form of the present disclosure.

The clutch mechanism part 700 includes a clutch guider 710, a clutch body 720, a clutch lever 730, a lever supporting part 740 and a clutch driving apparatus 750.

The clutch guider 710 and the clutch body 720 are configured between the drum belt wheel 610 and the wing belt wheel 510 in parallel on an axis direction of the first rotating shaft 200 and the second rotating shaft 300.

As shown in FIG. 5, the clutch guider 710 is of a cylindrical shape with an opened front surface; a rack 711 is formed on the entire outer circumferential surface of the clutch guider 710 throughout the entire circumference; an insertion hole 712 is formed in the central part of the clutch guider 710; the insertion hole 712 is formed with a keyway 713; the clutch guider 710 is penetrated by the second rotating shaft 300 through the insertion hole 712 and is fixed to the second rotating shaft 300 by a fixing method performed by using the keyway 713 and a key not shown in the figures; and as a result, the clutch guider 710 rotates together with the second rotating shaft 300.

As shown in FIG. 5(*a*), the clutch body 720 includes a clutch part 721, a surrounding part 722 and a rolling bearing 723. The clutch part 721 is of a cylindrical shape with an opened front surface and an opened rear surface; as shown in FIG. 6, a front rack 724 and rear rack 725 are respectively formed at the front part and the rear part on the outer circumferential surface of the clutch part 721 throughout the entire circumference.

An inner diameter of the clutch part 721 is roughly equal to the outer diameter of the clutch guider 710; a front-and-back dimension of the clutch part 721 is set to be larger than the front-and-back dimension of the clutch guider 710; the clutch guider 710 is inserted into the interior of the clutch part 721; an inner rack 726 is formed on the inner circumferential surface of the clutch part 721 throughout the entire circumference; the inner rack 726 is meshed with the rack 711 of the clutch guider 710; and the front-and-back dimension of the inner rack 726 is set to be greater than the front-and-back dimension of the rack 711.

The clutch part 721 is in a state that the clutch part 721 can move to the axis direction of the second rotating shaft 300 relative to the clutch guider 710, i.e., the second rotating shaft 300 where the clutch guider 710 is fixed, and can rotate together with the second rotating shaft 300, by the engagement of the inner rack 726 and the rack 711.

The encircling part 722 is formed in an annular shape and encircles the central part of the clutch part 721 in a manner of enabling the clutch part 721 to rotate freely; a rolling bearing 723 is arranged between the clutch part 721 and the encircling part 722; the rolling bearing 723 is fixed by a large and a small retaining rings 727 and 728 in a manner of prohibiting forward and backward movements; and the clutch part 721 smoothly rotates relative to the encircling part 722 through the rolling bearing 723.

The clutch lever 730 is connected with the encircling part 722 in a manner of enabling the upper end part of the clutch lever 730 to rotate relative to the encircling part 722; and in addition, the clutch lever 730 is supported on a fulcrum shaft 741 arranged on the level supporting part 740 in a freely rotatable manner.

The clutch driving apparatus 750 includes an actuator 751 and an operation lever 752. The actuator 751 enables the operation lever 752 to move forward and backward; the operation lever 752 is connected with the lower end part of the clutch lever 730; and the lower end part of the clutch lever 730 is rotatable relative to the operation lever 752.

The level supporting part 740 and the clutch driving apparatus 750 are fixed on a mounting plate not shown in the figures, and the mounting plate is mounted on the bearing unit 400 or the outer tank 20.

It should be noted that the clutch lever 730, the lever supporting part 740 and the clutch driving apparatus 750 constitute a moving mechanism part for enabling the clutch body 720 to move.

As shown in FIG. 2, the operation lever 752 is pushed forward from the interior of an actuator 751 when the driving form of the driving part 30 is switched from the uniaxial driving form to the biaxial driving form; the lower end part of the clutch lever 730 is pushed by the operation lever 752 to move forward; the clutch lever 730 rotates backwards by using the fulcrum shaft 741 as the center; the upper end part of the clutch lever 730 moves backwards; the clutch body 720 is pushed by the upper end part of the clutch lever 730 to move backwards; and as a result, the rear rack 725 of the clutch part 721 is engaged with the rack 515 of the wing belt wheel 510.

When the rear rack 725 is engaged with the rack 515, a state that the rotation of the wing belt wheel 510 can be transmitted to the second rotating shaft 300 by the clutch part 721 and the clutch guider 710 is formed since the clutch part 721 and the wing belt wheel 510 are fixed relative to the rotation direction; in this state, the rotation is transmitted to the second rotating shaft 300 by the wing decelerating mechanism 500 when the driving motor 100 is rotated; the rotating body 24 fixed to the second rotating shaft 300 rotates; the rotating body 24 rotates at the rotating speed that the rotating speed of the driving motor 100 decreases as the deceleration ratio generated by the wing decelerating mechanism 500; in addition, the rotation of the driving motor 100 is transmitted to the first rotating shaft 200 by the drum decelerating mechanism 600; the drum 22 fixed to the first rotating shaft 200 rotates; the drum 22 rotates at the rotating speed that the rotating speed of the driving motor 100 decreases as the deceleration ratio generated by the drum decelerating mechanism 600. As described above, the rotating body 24 rotates at the rotating speed higher than that of the drum 22 in the same direction as that of the drum 22 since the deceleration ratio generated by the drum decelerating mechanism 600 is greater than the deceleration ratio generated by the wing decelerating mechanism 500.

Although the clutch part 721 rotates together with the wing belt wheel 510 here, the rotation would not be substantially transmitted to the clutch lever 730 even if the clutch part 721 rotates since the clutch lever 730 is connected with the connected surrounding part 722 which is connected with the clutch part 721 in a freely rotatable state.

On the other hand, as shown in FIG. 3, the operation lever 752 is withdrawn into interior of the actuator 751, namely the operation lever 752 moves backwards, when the driving form of the driving part 30 is switched from the biaxial driving form to the uniaxial driving form; the lower end part of the clutch lever 730 is pulled by the operation lever 752 and moved to the rear; the clutch lever 730 rotates forward by using the fulcrum shaft 741 as the center; the upper end part of the clutch lever 730 moves forward; the clutch body 720 is pushed by the upper end part of the clutch lever 730 to move forward; and as a result, the front rack 724 of the clutch part 721 is engaged with the rack 615 of the drum belt wheel 610.

Since the clutch part 721 and the drum belt wheel 610 are fixed relative to the rotation direction when the front rack 724 is engaged with the rack 615, a state that the rotation of the drum belt wheel 610 can be transmitted to the second rotating shaft 300 through the clutch part 721 and the clutch guider 710 is formed; in this state, the rotation is transmitted to the first rotating shaft 200 and the second rotating shaft 300 by the drum decelerating mechanism 600 when the motor 100 rotates, so that the drum 22 and the rotating body 24 rotate; and the drum 22 and the rotating body 24 integrally rotates in the same direction at the rotating speed that the rotating speed of the driving motor 100 decreases as the deceleration ratio generated by the drum decelerating mechanism 600.

It should be noted that when the driving motor 100 rotates, the wing belt wheel 510 also rotates with the rotation in the uniaxial driving form; however, the wing belt wheel 510 only idles relative to the second rotating shaft 300; and the rotation of the wing belt wheel 510 would not be transmitted to the second rotating shaft 300.

Figure 7:
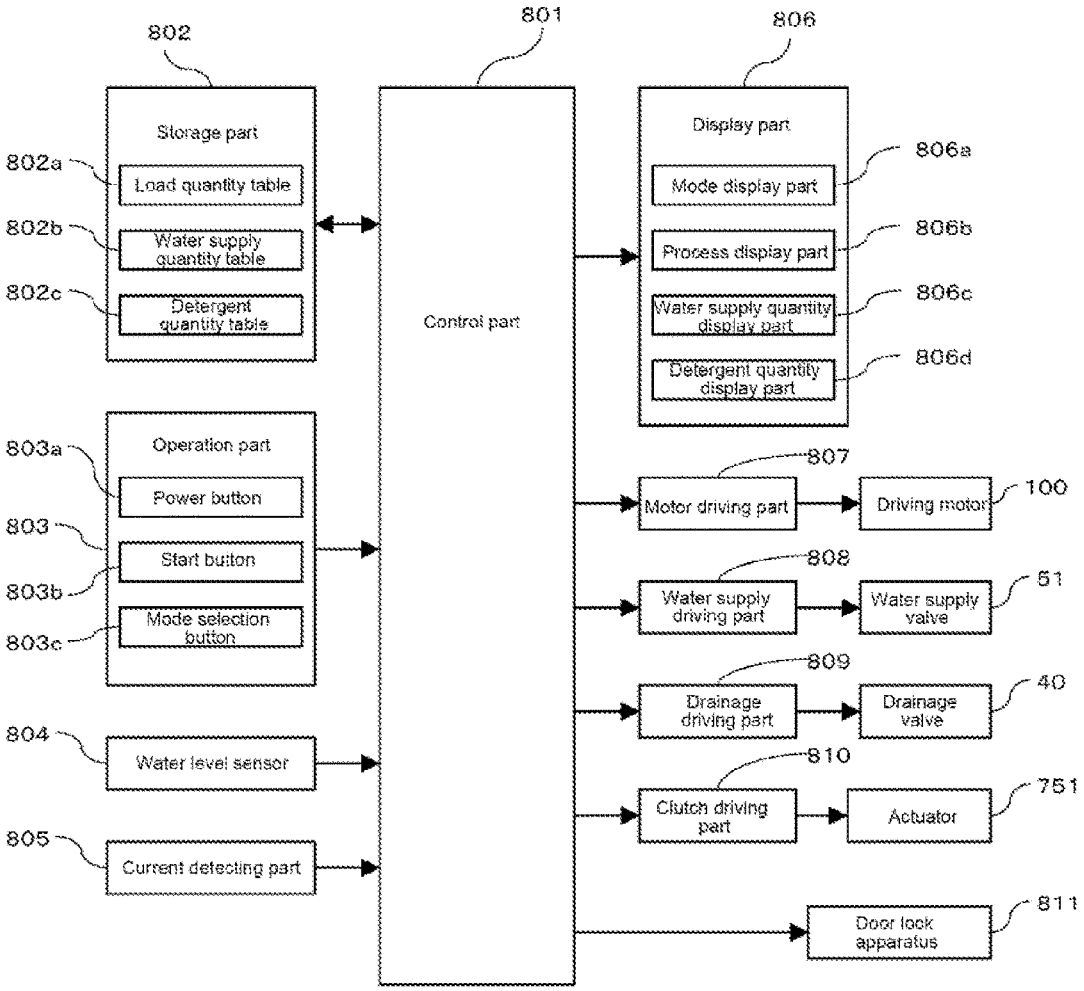
FIG. 7 is a block diagram illustrating a structure of a drum washing machine involved in embodiments.

FIG. 7 is a block diagram illustrating the structure of the drum washing machine 1.

Besides the above structures, the drum washing machine 1 also includes a control part 801, a storage part 802, an operation part 803, a water level sensor 804, a current detecting part 805, a display part 806, a motor driving part 807, a water supply driving part 808, a drainage driving part 809, a clutch driving part 810 and a door lock apparatus 811.

The operation part 803 includes a power button 803*a*, a start button 803*b* and a mode selection button 803*c*; the power button 803*a* is a button for turning on and off a power supply of the drum washing machine 1; the start button 803*b* is a button for starting the washing operation; the mode selection button 803*c* is a button for selecting any washing mode from a plurality of washing modes for the washing operation; and the operation part 803 outputs an input signal corresponding to a button operated by a user to the control part 801.

The water level sensor 804 detects a water level in the outer tank 20, and outputs a water level detection signal corresponding to the detected water level to the control part 801.

The display part 806 includes a mode display part 806*a*, a process display part 806*b*, a water supply quantity display part 806*c* and a detergent quantity display part 806*d*. The mode display part 806*a* displays the washing mode selected by the mode selection button 803*c*; and the process display part 806*b* displays the ongoing process during washing operation. The water supply quantity display part 806*c* displays the quantity, determined according to the load quantity of the washings in the drum 22, of the water supplied into the outer tank 20, i.e., a water supply quantity. The detergent quantity display part 806*d* displays the quantity, determined according to the load quantity of the washings in the drum 22, of detergents supplied into the drum 22, i.e., a detergent quantity.

The motor driving part 807 supplies driving current to the driving motor 100 in accordance with a control signal from the control part 801; the motor driving part 807 includes a speed sensor for detecting the rotating speed of the driving motor 100, a frequency converter circuit and the like; and the driving current is adjusted so that the driving motor 100 rotates at the rotating speed set by the control part 801.

The current detecting part 805 detects the driving current provided by the motor driving part 807 to the driving motor 100, and outputs a detecting signal corresponding to the magnitude of the driving current to the control part 801.

The water supply driving part 808 supplies the driving current to the water supply valve 51 in accordance with the control signal from the control part 801; the drainage driving part 809 supplies the driving current to the drainage valve 40 in accordance with the control signal from the control part 801.

The clutch driving part 810 supplies the driving current to the actuator 751 in accordance with the control signal outputted from the control part 801.

The door lock apparatus 811 locks and unlocks a door 12 in accordance with the control signal from the control part 801.

The storage part 802 includes an EEPROM, a RAM and the like; the storage part 802 stores procedures for executing the washing operation of various washing modes; and in addition, the storage part 802 stores various parameters and various control marks for the execution of the procedures.

Further, the storage part 802 includes a load quantity table 802*a*, a water supply quantity table 802*b* and a detergent quantity table 802*c*. FIGS. 8(*a*), (*b*) and (*c*) are diagrams illustrating the load quantity table 802*a*, the water supply quantity table 802*b* and the detergent quantity table 802*c* respectively.

As shown in FIG. 8(*a*), a plurality of load capacities and a range of a difference between a second current value and a first current value that are corresponding to the load capacities are stored in the load quantity table 802*a*. The first current value refers to a value of the driving current provided for the driving motor 100 when the drum 22 rotates at a first attaching speed. The first attaching speed is a rotating speed that a centrifugal force applied to the washings in the drum 22 is larger than the gravity of the washings and the washings are attached to the inner circumferential surface of the drum 22. The second current value refers to a value of the driving current provided for the driving motor 100 when the drum 22 rotates at a second attaching speed higher than the first attaching speed. In addition, the first attaching speed and the second attaching speed are equivalent to a first rotating speed of the prevent disclosure.

Under the condition that drum 22 rotates at the first attaching speed or the second attaching speed, the more the load quantity is, the greater the rotating load applied to the drum 22 is, and thus, the rotating load applied to the driving motor 100 is greater; and therefore, the first current value and the second current value are larger. Under the condition that a certain amount of load capacities are increased, the increment of the second current value is more than that of the first current value. Therefore, the more the load quantity is, the greater the difference between the second current value and the first current value is. In the load quantity table 802*a*, the greater the difference is, the greater the value of the corresponding load quantity is. The load quantity corresponding to the range of the differences is determined through a test in advance.

As shown in FIG. 8(*b*), a plurality of load capacities and water supply quantities corresponding to the load capacities are stored in the water supply quantity table 802*b*. The more the load quantity is, the more the water volume needed by washing is; and therefore, in the water supply quantity table 802*b*, the greater the value of the load quantity is, the greater the corresponding water supply quantity is.

As shown in FIG. 8(*c*), a plurality of load capacities and detergent quantities corresponding to the load capacities are stored in the detergent quantity table 802*c*. The more the load quantity is, the more the detergent needed by washing is; and therefore, in the detergent quantity table 802*c*, the greater the value of the load quantity is, the greater the corresponding detergent quantity is.

The control part 801 controls the display part 806, the motor driving part 807, the water supply driving part 808, the drainage driving part 809, the clutch driving part 810, the door lock apparatus 811 and the like according to the procedures stored in the storage part 802 based on the signals from the operation part 803, the water level sensor 804, the current detecting part 805, and the like.

The drum washing machine 1 performs the washing operation of various operation modes according to user selection operation performed by the mode selection button 803*c*; the washing process, an intermediate dewatering process, the rinsing process and a final dewatering process are sequentially performed in the washing operation; and in addition, the intermediate dewatering process and the rinsing process may be performed more than twice sometimes according to the washing mode.

The driving form of the driving part 30 is switched to the biaxial driving form in the washing process and the rinsing process. If the water stored in the outer tank 20 does not reach a specified water level at the lower edge of the throwing inlet 11, the washings in the drum 22 are immersed into the water. In this state, the driving motor 100 performs forward rotation and backward rotation alternately. Thus, the drum 22 and the rotating body 24 alternately perform forward rotation and backward rotation in a state that the rotating speed of the rotating body 24 is higher than that of the drum 22. At this moment, the drum 22 rotates at a rotating speed that the centrifugal force acting on the washings becomes smaller than the gravity of the washings.

The washings in the drum 22 are lifted up and dropped down by the baffles 23 and are rolled in the drum 22. Thus, the washings are thrown to the inner circumferential surface of the drum 22. In addition, the washings are in contact with the protruding part 24*a* of the rotating stirring body 24 at the rear of the drum 22, and the washings are rubbed and stirred through the protruding part 24*a*. Therefore, the washings are washed or rinsed.

In this way, since not only mechanical force produced by rotation of the drum 22 but also mechanical force produced by the stirring body 24 can be applied to the washings during washing and rinsing, and therefore, improvement of the cleaning performance can be expected. The driving form of the driving part 30 is switched to the uniaxial driving form in an intermediate dewatering process and a final dewatering process. The drum 22 and the rotating body 24 integrally rotate at a rotating speed that the centrifugal force acting on the washings in the drum 22 is far larger than the gravity of the washings when the driving motor 100 works. Due to the action of the centrifugal force, the washings are pressed on the inner circumferential surface of the drum 22 for dewatering.

In this way, since the drum 22 and the rotating body 24 integrally rotate during dewatering, the washings attached to the drum 22 can be well dewatered without the need of stirring the washings by the rotating body 24.

In addition, in the drum washing machine 1 of the present embodiment, when starting the washing operation and before washing, the load quantity of the washings in the drum 22 is firstly detected, and the water supply quantity and the detergent quantity are determined based on the detected load quantity. The determined water supply quantity and the detergent quantity are displayed by the water supply quantity display part 806*c* and a detergent quantity display part 806*d* respectively.

Figure 9:
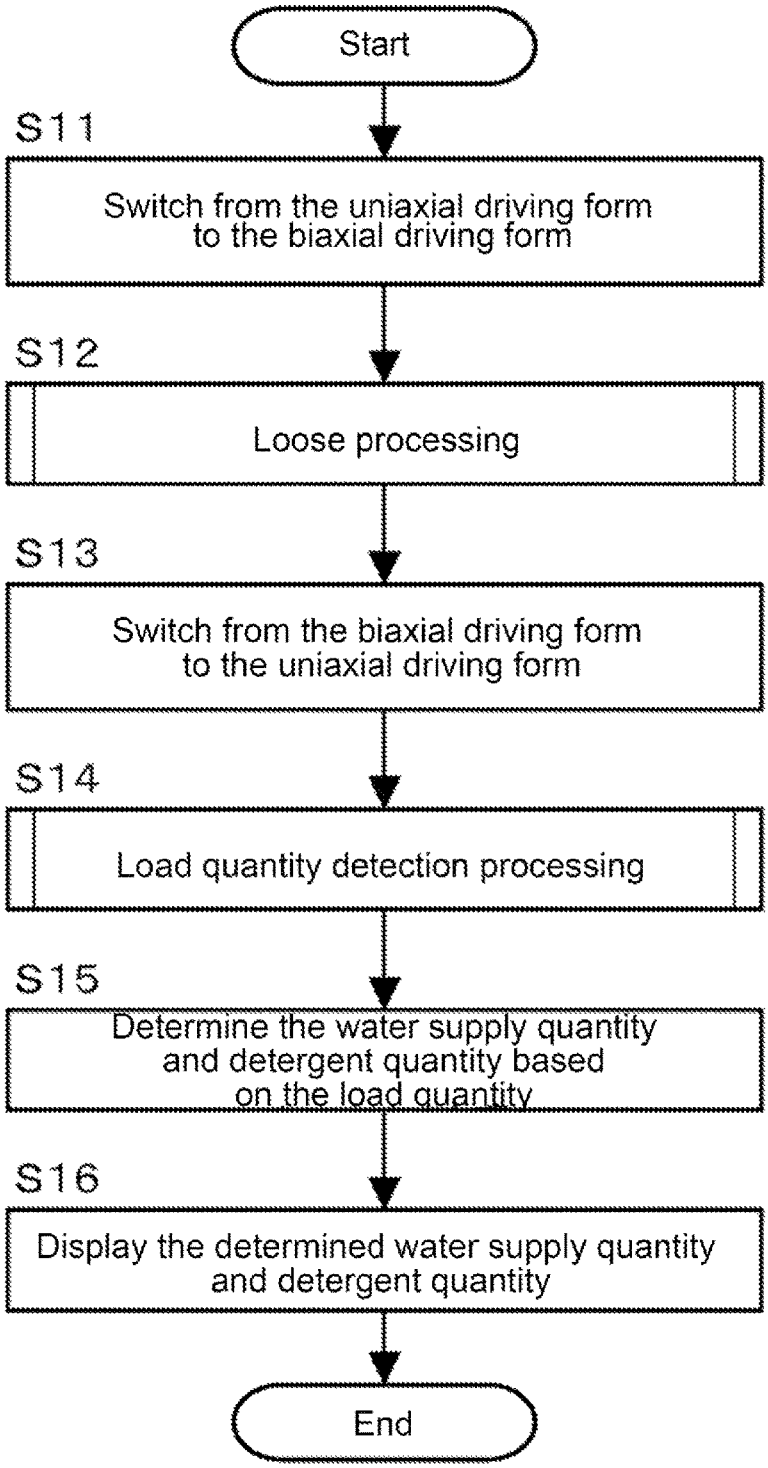
FIG. 9 is a flow chart illustrating control processing for displaying water supply quantity and detergent quantity corresponding to a load quantity involved in embodiments.
Figure 10:
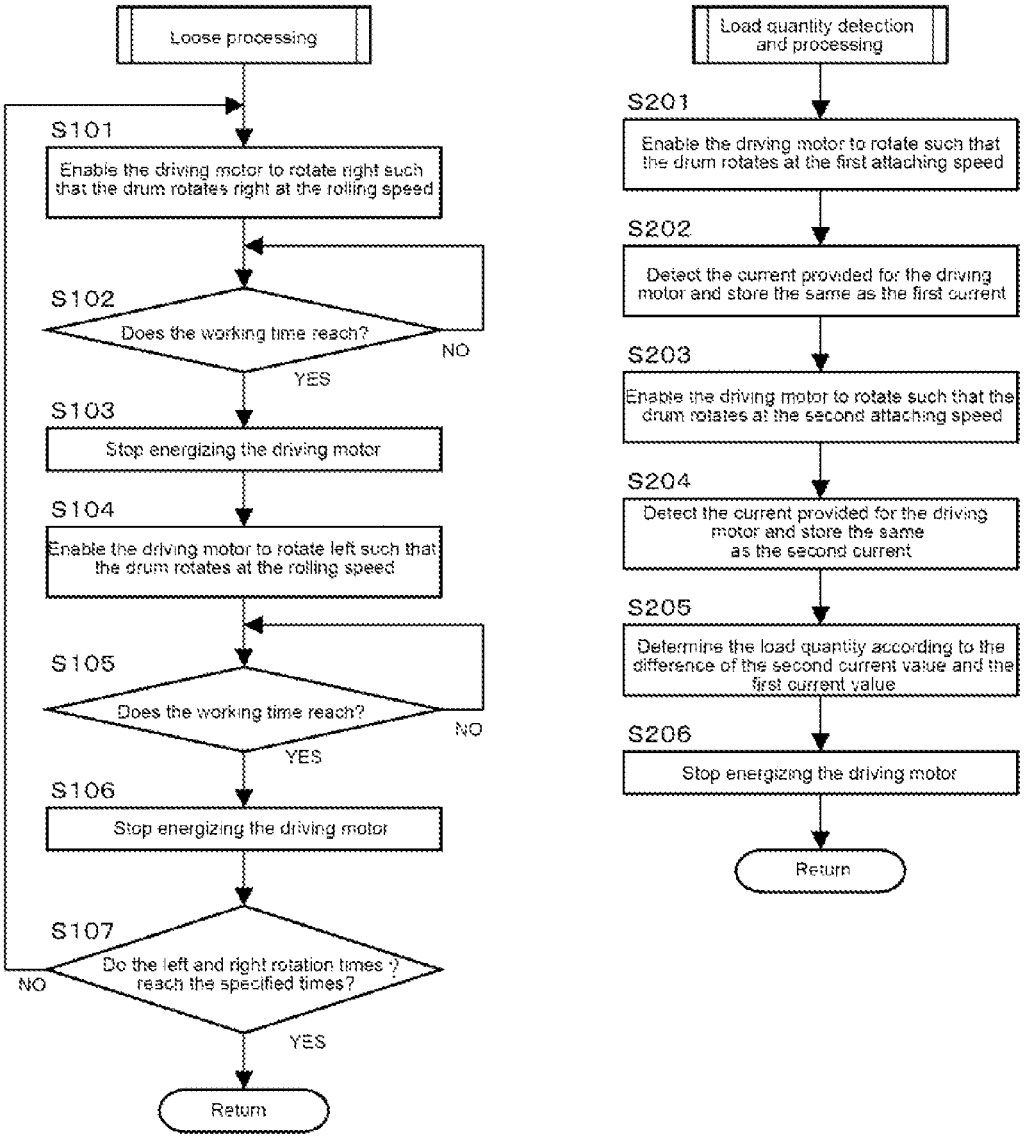
FIG. 10 is a flow chart illustrating loose processing and load quantity detection processing involved in embodiments.

FIG. 9 is a flow chart illustrating control processing for displaying a water supply quantity and a detergent quantity corresponding to a load quantity. FIG. 10(*a*) is a flow chart illustrating loose processing, and FIG. 10(*b*) is a flow chart illustrating load quantity detection processing.

The control processing in FIG. 9 is started when the washing operation is started. At the beginning of starting washing operation, the driving form of the driving part 30 is switched to the uniaxial driving form.

By referring to FIG. 9, the control part 801 firstly enables the actuator 751 to work such that the clutch body 720 moves towards the side of the wing belt wheel 510, and the driving form of the driving part 30 is switched from the uniaxial driving form to the biaxial driving form (S11).

When the washings are thrown into the drum 22, the user may sometimes throw the washings in the drum 22 one by one, and sometimes, throw a plurality of washings in the drum 22 by bunching up the washings. If the washings are thrown in after being bunched up, this state is kept unchanged, and when the rotating speed of the drum 22 is accelerated until the rotating speed that the washings are attached to the inner circumferential surface of the drum 22 is reached so as to detect the load quantity, the washings are easily and intensively attached to some position of the inner circumferential surface of the drum 22.

Therefore, the loose processing shown in FIG. 10(*a*) is carried out before the control part 801 detects the load quantity (S12).

By referring to FIG. 10(*a*), the control part 801 enables the driving motor 100 to rotate right (S101), so that the drum 22 rotates right at the rolling speed. The rolling speed refers to the rotating speed that the centrifugal force acting on the washings is smaller than the gravity of the washings and the washings can be rolled in the drum 22. For example, when an inside diameter of the drum 22 is about 520 mm, the rolling speed is set as 45 rpm. The rolling speed is equivalent to the second rotating speed of the present disclosure.

When reaching the specified working time (S102: YES), the control part 801 stops energizing the driving motor 100, so that the drum 22 is stopped temporarily (S103). Then, the control part 801 immediately enables the driving motor 100 to rotate left (S104), so that the drum 22 rotates left at the rolling speed.

When reaching the specified working time (S105: YES), the control part 801 stops energizing the driving motor 100, so that the drum 22 is stopped (S106). Then, the control part 801 judges whether the drum 22 conducts the left and right rotation of specified times (S107). If the left and right rotation times do not reach the specified times (S107: NO), the control part 801 returns the processing to S101, so that the drum 22 conducts the left and right rotation alternately again (S101-S106). In this way, the drum 22 repeats the left and right rotation, and the washings are rolled in a dextrorotary and levorotatory manner repeatedly, until the left and right rotation of the drum 22 is conducted for the specified time. Thus, the washings bunched up would be loosened under a condition that the washings bunched up exist in the drum 22. And then, at this time, the driving form of the driving part 30 has been switched to the biaxial driving form, and the rotating body 24 rotates relative to the drum 22 at the rear of the drum 22. Therefore, the washings are also stirred by the rotating body 24, and the washings bunched up are loosened more easily.

When the left and right rotation times reach the specified times (S107: YES), the control part 801 finishes the loose processing.

By returning to FIG. 9, when the loose processing is finished, the control part 801 enables the actuator 751 to work such that the clutch body 720 moves towards the side of the drum belt wheel 610, and thus, the driving form of the driving part 30 is switched from the biaxial driving form to the uniaxial driving form (S13). Then, the control part 801 conducts the load quantity detection processing shown in FIG. 10(*b*) (S14).

By referring to FIG. 10(*b*), the control part 801 enables the driving motor 100 to rotate unidirectionally (S201), so that the drum rotates unidirectionally at the first attaching speed. The first attaching speed is the rotating speed that the centrifugal force acting on the washings is larger than the gravity of the washings and the washings are attached to the inner circumferential surface of the drum 22. For example, when the inner diameter of the drum 22 is about 520 mm, the first attaching speed is set as 65 rpm. Since the washings in the drum 22 are loosened through the loose processing just, the washings are easily dispersed, and attached to the whole inner circumferential surface of the drum 22 when the rotating speed of the drum 22 is accelerated to the first attaching speed.

Then, when the drum 22 rotates at the first attaching speed, the value of the driving current provided for the driving motor 100 is detected by control part 801 through a current detection part 805, and stored in the storage part 802 as the first current value (S202).

The control part 801 accelerates the rotating speed of the driving motor 100 to enable the driving motor 100 to rotate (S203), so that the drum 22 rotates unidirectionally at the second attaching speed which is higher than the first attaching speed. For example, when the inner diameter of the drum 22 is about 520 mm, the second attaching speed is set as 165 rpm. Then, when the drum 22 rotates at the second attaching speed, the value of the driving current provided for the driving motor 100 is detected by control part 801 through the current detection part 805, and stored in the storage part 802 as the second current value (S204).

The control part 801 obtains the difference between the second current value and the first current value stored in the storage part 802, and determines the load quantity by referring to the load quantity table 802*a* according to the obtained difference (S205). Then, the control part 801 finishes the load quantity detection processing after stopping energizing the driving motor 100 to enable the drum 22 to stop (S206).

Herein, when the load quantity is detected, the driving form of the driving part 30 has been switched to the uniaxial driving form, and the drum 22 and the rotating body 24 integrally rotate. Namely, the rotating body 24 does not rotate relative to the drum 22.

When it is assumed that the driving motor 100 rotates in the biaxial driving form, and since the rotating body 24 rotates relative to the drum 22, the possibility that a part of washings is in contact with the rotating body 24 at the rear of the drum 22 and is rubbed by the rotating body 24 exists. The drum 22 rotates at the rotating speed that the washings are attached to the inner circumferential surface of the drum 22, since the rotating speed is higher than that in a washing process, a rinsing process and the previous loose processing. Consequently, the rotating speed of the rotating body 24 also becomes fast. Therefore, the possibility of the cloth damage of the washings in contact with the rotating body 24 exists.

In the present embodiment, since the drum 22 and the rotating body 24 integrally rotate, and the rotating body 24 does not rotate relative to the drum 22, the washings are not rubbed by the rotating body 24 with high rotating speed, and the cloth damage of the washings due to the rotation of the rotating body 24 is not caused.

In addition, the load quantity can also be determined based on a single driving current value, rather than the difference between the two driving current values at the different rotating speeds like the present embodiment. However, the driving current value may make a difference due to voltage change of an external commercial power supply and manufacturing error of products. When the difference between the two driving current values is obtained like the present embodiment, the precision of the load detection detected can be improved, since such difference can be offset.

By returning to FIG. 9 again, the control part 801 determines the water supply quantity and the detergent quantity by referring to the water supply table 802*b* and the detergent quantity table 802*c* respectively based on the determined load quantity (S15). Then, the control part 801 displays the determined water supply quantity on the water supply quantity display part 806*c*, and displays the determined detergent quantity on the detergent quantity display part 806*d* (S16). Then, the control part 801 finishes the control processing in FIG. 9.

The user confirms the detergent quantity displayed by the detergent quantity display part 806*d*, and throws the quantity of detergent into the detergent box 50. And then, the control part 801 only supplies a determined water supply quantity of water to the outer tank 20 in the washing process and the rinsing process.

Effect of the Embodiment

According to the present embodiment, when the load quantity of the washings in the drum 22 is detected, the driving part 30 is operated in the uniaxial driving form. In the uniaxial driving form, since the drum 22 and the rotating body 24 integrally rotate and the rotating body 24 does not rotate relative to the drum 22, the washings are rubbed by the rotating body 24 that rotates. Therefore, the load quantity is detected without worrying about cloth damage of the washings due to the rotation of the rotating body 24.

Further, according to the present embodiment, the drum washing machine enables the drum 22 to rotate at the rotating speed at which the washings can be attached to the inner circumferential surface of the drum 22, and detects the load quantity based on the rotating load applied to the drum 22 during rotation. More specifically, in the present embodiment, the load quantity is detected based on a difference between a driving current value of the driving motor 100 detected at the second attaching speed and a driving current value of the driving motor 100 detected at the first attaching speed.

In this way, under the condition of adopting the structure that the drum 22 rotates at the rotating speed at which the washings can be attached to the inner circumferential surface of the drum 22 in order to detect the load quantity, when a structure is adopted that enables the driving part 30 to operate in the biaxial driving form when the load quantity is detected, since the rotating body 24 rotates at the rotating speed higher than that in a washing process and that in a rinsing process, cloth damage of the washings is generated more possibly. Therefore, in such structure, if the structure is adopted that the driving part 30 is operated in the uniaxial driving form when the load quantity is detected, since cloth damage of the washings does not need to be worried about, such structure is also applicable.

Further, according to the present embodiment, before the load quantity is detected, the driving part 30 is operated in the biaxial driving form, so that the drum 22 rotates at a rolling speed at which the washings can be rolled in the drum 22. Thus, since the washings can be loosened before the load quantity is detected, the washings can be loosened and attached to the inner circumferential surface of the drum 22 when the load quantity is detected. Therefore, eccentric rotation of the drum 22 caused by centralized attachment of the washings can be inhibited so as to detect the load quantity with good precision. Moreover, since the washings not only are rolled due to the rotation of the drum 22, but also are stirred by the rotating body 24, a coil of washings becomes easier to be loosened

Change Embodiment

Figure 11:
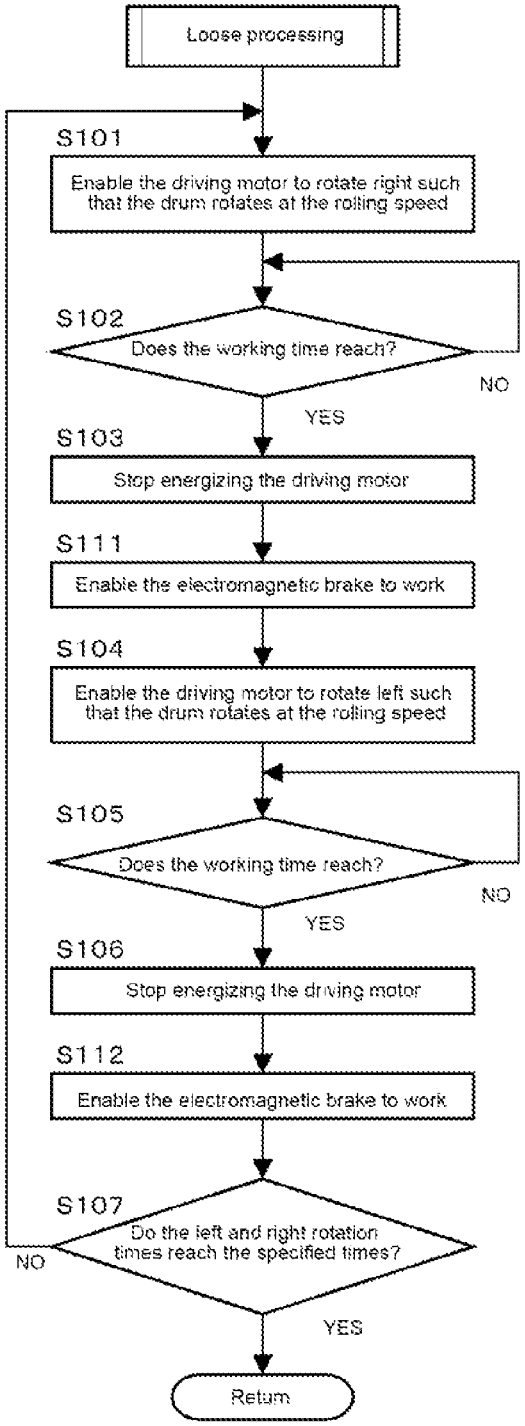
FIG. 11 is a flow chart illustrating loose processing involved in a change embodiment.

FIG. 11 is a flow chart illustrating loose processing involved in the change embodiment.

In the loose processing of FIG. 11, compared with the loose processing of FIG. 10(*a*), processing of Step 111 is added after the processing of S103, and the processing of S112 is added after the processing of S106.

In the present change embodiment, the motor driving part 807 enables a short circuit brake as one of electromagnetic brakes to act on the rotating driving motor 100 by enabling the coil of the driving motor 100 to be short-circuited, thereby braking the driving motor 100. By braking the driving motor 100, the drum 22 connected with the driving motor 100 through the drum decelerating mechanism 600 and the first rotating shaft 200 is braked. The motor driving part 807 not only plays a role as the motor driving part of the present disclosure, but also plays a role as a braking part.

As shown in FIG. 11, the control part 801 stops energizing the driving motor 100 when enabling the drum 22 rotating right at the rolling speed to stop (S103), and enables the electromagnetic brake to work through the motor driving part 807 (S111). Similarly, the control part 801 stops energizing the driving motor 100 when enabling the drum 22 rotating right at the rolling speed to stop (S106), and enables the electromagnetic brake to work through the motor driving part 807 (S112). Therefore, since the drum 22 is stopped rapidly due to braking, at this time, the washings bunched up are easily loosened due to the big inertia force acting on the washings in the drum 22.

Other Change Embodiments

Embodiments of the present disclosure are described above. However, the present disclosure is not limited to any of the above embodiments. In addition, embodiments of the present disclosure can also be subjected to various changes in addition to the above.

For example, in the above embodiment, the load quantity is detected based on the magnitude of the driving current provided for the driving motor 100 when the drum 22 rotates. However, a method of detecting the load quantity which is conducted by rotating the drum 22 is not limited to this. For example, after the drum 22 is rotated, by stopping energizing the driving motor 100, the load quantity can also be detected based on the time required by the drum 22 to stop rotating, i.e. an inertia rotation time of the drum 22. Then, in the above embodiment, the load quantity is detected based on the rotating load applied to the drum 22 when the drum 22 rotates at the rotating speed that the washings are attached to the inner circumferential surface of the drum 22, and can also be detected based on the rotating load applied to the drum 22 when the rotating speed of the drum 22 is accelerated to the rotating speed that the washings are attached to the inner circumferential surface of the drum 22. In this case, the rotating load can be detected by the magnitude of the current provided for the driving motor and time required by acceleration.

In addition, in the loose processing of the above embodiment, the drum 22 rotates left and right alternately. However, the drum 22 can also rotate towards one of left and right directions.

Further, in the above embodiment, the loose processing is carried out before the load quantity detection processing. However, a structure that the loose processing is not carried out can also be adopted. In this case, the control part 801 enables the driving form of the driving part 30 to be kept at the uniaxial driving form, and enables the driving motor 100 to rotate in this state to detect the load quantity.

Further, in the loose processing of the above change embodiment, the drum 22 is braked by enabling the electromagnetic brake to act on the driving motor 100. However, the drum 22 can also be braked through a belt brake and other mechanical brake mechanisms.

Further, in the above embodiment, the drum 22 rotates by using the inclination shaft inclining relative to the horizontal direction as the center; however, the drum 22 of the drum washing machine 1 can also be a structure which rotates by using the horizontal shaft as the center.

Further, the drum washing machine 1 of the above embodiment does not have the drying function. However, the present disclosure is also applicable to the drum washing machine with the drying function, i.e., a drum washing and drying machine.

In addition, embodiments of the present disclosure can be subjected to various changes within the scope of a technical idea shown in claims.

A LIST OF REFERENCE NUMERALS

10: Shell; 20: Outer tank; 22: Drum; 24: Rotating body; 24*a*: Protruding part; 30: Driving part; 100: Driving motor; 801: Control part; 805: Current detecting part; 807: Motor driving part (braking part).

What is claimed is:

1. A drum washing machine, comprising:

an outer tank configured in a shell;

a drum configured in the outer tank and capable of rotating by using a horizontal axis or an inclination axis inclining relative to a horizontal direction as a center;

a rotating body arranged at a rear part of the drum and provided with a protruding part in contact with washings on a surface of the rotating body;

a driving part capable of operating in a first driving form and a second driving form, wherein the first driving form is a driving form that enables the drum and the rotating body to rotate at different rotating speeds, and the second driving form is a driving form that enables the drum and the rotating body to integrally rotate at a same rotating speed; and a control part, wherein the control part detects load quantity of the washings in the drum, and enables the driving part to operate in the second driving form while detecting the load quantity;

wherein the driving part comprises a driving motor, a first rotating shaft, a second rotating shaft, a wing decelerating mechanism, a drum decelerating mechanism, and a clutch mechanism part, the clutch mechanism part configured to switch a driving form of the driving part between the first driving form and the second driving form;

wherein the driving motor is configured to generate torque for driving the drum and the rotating body;

wherein the first rotating shaft has a hollow shape, and a first sliding bearing and a second sliding bearing are respectively arranged at a front part and a rear part of an inner part of the first rotating shaft;

wherein the second rotating shaft is encircled by the first rotating shaft, a front part of the second rotating shaft protruding forward of the first rotating shaft, a rear part of the second rotating shaft protruding backwards of the first rotating shaft, an outer circumferential surface of the second rotating shaft supported by the first sliding bearing and the second sliding bearing, and the second rotating shaft rotatable within the first rotating shaft;

wherein the wing decelerating mechanism comprises a wing belt wheel, a first motor belt wheel, and a wing transmission belt, the wing decelerating mechanism configured to decelerate a rotation of the driving motor according to a deceleration ratio determined by an outer diameter ratio of the wing belt wheel to the first motor belt wheel and transmit the rotation being decelerated to the second rotating shaft;

wherein the drum decelerating mechanism comprises a drum belt wheel, a second motor belt wheel, and a drum transmission belt, the drum decelerating mechanism configured to decelerate a rotation of the driving motor according to the deceleration ratio determined by the outer diameter ratio of the drum belt wheel to the second motor belt wheel and transmit the rotation being decelerated to the first rotating shaft; and wherein, in the first driving form, the second rotating shaft is connected to the wing belt wheel for transmitting the rotation of the wing belt wheel to the second rotating shaft so as to rotate the drum and the rotating body at different rotating speeds and, in the second driving form, the second rotating shaft is connected to the drum belt wheel for transmitting the rotation of the drum belt wheel to the second rotating shaft so as to rotate the drum and the rotating body at the same rotating speed.

2. The drum washing machine according to claim 1, wherein the control part enables the driving part to operate in the second driving form so that the drum rotates at a first rotating speed at which the washings are at least attached to an inner circumferential surface of the drum, and detects the load quantity based on rotating load applied to the drum when the drum rotates at the first rotating speed.

3. The drum washing machine according to claim 2, wherein:

the driving part comprises a driving motor that generates a torque for enabling the drum and the rotating body to rotate;

the drum washing machine further comprises a motor driving part for providing driving current to the driving motor, and a current detecting part for detecting the driving current; and the control part enables the driving motor to operate in the second driving form so that the drum rotates at the first rotating speed, and detects the load quantity based on magnitude of the driving current detected by the current detecting part when the drum rotates at the first rotating speed.

4. The drum washing machine according to claim 2, wherein, before the driving part is operated in the second driving form for detecting the load quantity, the control part enables the driving part to operate in the first driving form so that the drum rotates at a second rotating speed at which the washings can be rolled in the drum.

5. The drum washing machine according to claim 4, further comprising a braking part for braking the rotating drum; and wherein the control part brakes the drum through the braking part when stopping the drum rotating at the second rotating speed.

6. The drum washing machine according to claim 3, wherein, before the driving part is operated in the second driving form for detecting the load quantity, the control part enables the driving part to operate in the first driving form so that the drum rotates at a second rotating speed at which the washings can be rolled in the drum.

7. The drum washing machine according to claim 6, further comprising a braking part for braking the rotating drum; and wherein the control part brakes the drum through the braking part when stopping the drum rotating at the second rotating speed.

* * * * *